US010415944B2

(12) United States Patent
Winter et al.

(10) Patent No.: US 10,415,944 B2
(45) Date of Patent: Sep. 17, 2019

(54) ELECTRONIC PRIMER CAP FOR SMALL-CALIBER AMMUNITION

(71) Applicant: RUAG Ammotec GmbH, Fürth (DE)

(72) Inventors: Andreas Winter, Fürth (DE); Wolfgang Mosig, Hartmannshof (DE); Ulrich Bley, Fürth (DE); Aleksej Hoschenko, Fürth (DE); Martin Liebl, Roth (DE)

(73) Assignee: RUAG AMMOTEC GMBH, Fürth (DE)

( * ) Notice: Subject to any disclaimer, the term of this patent is extended or adjusted under 35 U.S.C. 154(b) by 0 days.

(21) Appl. No.: 14/910,017

(22) PCT Filed: Aug. 5, 2014

(86) PCT No.: PCT/EP2014/066817

§ 371 (c)(1),
(2) Date: Feb. 4, 2016

(87) PCT Pub. No.: WO2015/018828

PCT Pub. Date: Feb. 12, 2015

(65) Prior Publication Data

US 2016/0161237 A1 Jun. 9, 2016

(30) Foreign Application Priority Data

Aug. 5, 2013 (DE) ..... 10 2013 012 910

(51) Int. Cl.
*F42C 19/12* (2006.01)
*F42B 3/12* (2006.01)

(52) U.S. Cl.
CPC ..... *F42C 19/12* (2013.01); *F42B 3/12* (2013.01)

(58) Field of Classification Search
CPC ..... F42B 3/12; F42C 19/12
(Continued)

(56) References Cited

U.S. PATENT DOCUMENTS 2,972,951 A * 2/1961 Stresau ..... F42B 3/124 102/202.9
3,611,939 A * 10/1971 Stadler ..... C06C 7/00 102/202.8

(Continued)

FOREIGN PATENT DOCUMENTS

| | | |
|---|---|---|
| DE | 32 45 187 A1 | 6/1984 |
| EP | 0 112 254 A1 | 6/1984 |
| FR | 2 200 501 A1 | 4/1974 |

OTHER PUBLICATIONS

International Search Report for PCT/EP2014/066817 dated Aug. 29, 2014; English Translation submitted herewith (7 Pages).

*Primary Examiner* — Stephen Johnson
*Assistant Examiner* — Benjamin S Gomberg
(74) *Attorney, Agent, or Firm* — Fitch, Even, Tabin & Flannery, LLP

(57) ABSTRACT

The invention relates to a primer cap for small-caliber ammunition, having an outer metallic cup in which is arranged a priming composition which generates hot combustion gases following initiation. To enable more versatile control of the initiation process in the weapon, it is proposed that a resistance bridge which can be initiated electrically, and an electrically conductive pole piece, are additionally arranged in the primer cap, wherein the first pole of the resistance bridge is connected to the cup and the second pole is connected to the cup and the second pole is connected to the pole piece, which protrudes out of the cup and is electrically insulated from the same.

10 Claims, 3 Drawing Sheets

(58) Field of Classification Search
USPC ..... 102/202.7
See application file for complete search history.

(56) References Cited

U.S. PATENT DOCUMENTS

| | | | | | |
|---|---|---|---|---|---|
| 3,682,096 | A | | 8/1972 | Lüdke et al. | |
| 3,815,507 | A | * | 6/1974 | Irish, Jr. | B25C 1/16 102/202.8 |
| 3,850,101 | A | * | 11/1974 | Sower | F42B 5/08 102/202.8 |
| 3,867,885 | A | | 2/1975 | Gawlick et al. | |
| 4,014,264 | A | * | 3/1977 | Bendler | F42B 3/125 102/202.6 |
| 4,644,863 | A | * | 2/1987 | Bender | F42C 19/12 102/202.3 |
| 4,690,056 | A | * | 9/1987 | Brede | F42B 3/188 102/202.2 |
| 4,771,692 | A | * | 9/1988 | Ninio | F42C 19/12 102/202.2 |
| 4,881,463 | A | * | 11/1989 | Ninio | F42C 19/12 102/202.2 |
| 4,944,224 | A | * | 7/1990 | Fiedler | F42B 3/18 102/202.2 |
| 5,029,529 | A | * | 7/1991 | Mandigo | F42B 3/13 102/202.7 |
| 5,113,764 | A | * | 5/1992 | Mandigo | F42B 3/13 102/202.5 |
| 5,285,727 | A | * | 2/1994 | Reams, Jr. | F42B 3/188 102/202.5 |
| 5,361,702 | A | * | 11/1994 | Goetz | F42C 19/12 102/202.5 |
| 6,910,420 | B1 | * | 6/2005 | Thompson | C06B 33/00 102/202.5 |

* cited by examiner

ELECTRONIC PRIMER CAP FOR SMALL-CALIBER AMMUNITION

CROSS-REFERENCE TO RELATED APPLICATIONS

This application is a U.S. national phase application filed under 35 U.S.C. § 371 of International Application No. PCT/EP2014/066817, filed Aug. 5, 2014, designating the United States, which claims priority from German Patent Application No. 10 2013 012 910.9, filed Aug. 5, 2013, both of which are hereby incorporated herein by reference in their entirety for all purposes.

The invention relates to a primer cap for small-caliber ammunition, having an outer metallic cup in which is arranged a priming composition which generates hot combustion gases following initiation. A preferred use is also specified.

At present, a primer cap (ANZDH) is always used in small-caliber ammunition to ignite the propellant powder (TLP), said primer cap being initiated by the impact of a firing pin. In the initiation, a mixture of primary explosive substances and additives which release energy (the priming composition, AZM) are made to react chemically, and the hot combustion gases ignite the TLP. These primer caps are small and inexpensive to manufacture, but the required mechanism in the weapon is relatively complex.

The object of the invention is to improve a primer cap having an outer metallic cup in which is arranged a priming composition which generates hot combustion gases following irritation with respect to a more versatile control of the initiation process in the weapon.

This object is achieved according to the invention by, additionally arranging a resistance bridge, which can be initiated electrically, and an electrically conductive pole piece in the primer cap. The first pole of the resistance bridge is connected to the cup and the second pole is connected to the pole piece, which protrudes out of the cup and is electrically insulated from the same.

To enable more versatile control of the initiation process in the weapon, it is simpler to execute the initiation of the primer cap electrically. For this purpose, the primer cap must be constructed in such a manner that, with the same size, it contains components which can ensure the conversion of the electrical energy into a chemical reaction of the primer composition (AZM). The heat which is created when electrical current flows through an ohmic resistor is used for this purpose.

The outer dimensions of the primer cap correspond to those of a classical mechanical primer cap (ANZDH), so that it can continue to be used in standard cases for small-caliber ammunition. However, separation of the two electrical poles is additionally required. This is enabled by introducing an electrically conducting pole piece into the ANZDH.

Because a resistance bridge which can be initiated electrically, and an electrically conductive pole piece, are additionally arranged in the primer cap, wherein the first pole of the resistance bridge is connected to the cup and the second pole is connected to the pole piece, which protrudes out of the cup and is electrically insulated from the same, the initiation process in the weapon can be controlled in a versatile manner.

The base of the cup preferably has a hole passing through same, and the pole piece preferably has a pin which projects into the hole, wherein insulation is arranged between the pole piece and the cup.

The insulation is preferably elastic and does not break under compressive stress. The insulation is preferably made of vulcanized fiber. The pole piece is electrically isolated from the outer cup of the primer cap by the insulation. In addition, the insulation ensures impermeability to gas when the charge is ignited, by slightly compressing as a result of increasing pressure, and therefore pushing into any potential spaces. For this purpose, the insulation is made of a slightly elastic material which does not break under compressive stress.

In one advantageous embodiment, the pole piece has an overhang on its end which is opposite the hole. A disk, which is described below, lies on this overhang.

In one advantageous embodiment, a disk made of an electrically insulating material (e.g., FR4 or PVC), with an upper side, an underside which faces the pole piece, and a hole, is arranged in the cup, and the resistance bridge is arranged on the upper side, wherein the underside and the hole are metallized and are electrically connected to each other, and a metallic edge contact which is connected to the first pole of the resistance bridge is arranged on the edge of the upper side, and the second pole of the resistance bridge is connected to the metallizing of the hole, and the disk lies on the electrically conducting pole piece.

The edge contact is preferably connected to an electrically conducting support element which presses the underside of the disk against the pole piece and which contacts the inner wall of the cup. This ensures the electrical connection between the outer cup with the electrically conducting support element and up to the first pole of the resistance bridge, via the edge contact.

The support element is preferably the edge, curved inwardly by 180°, of the outer cup.

Alternatively, the support element can also be an inner cup with a smaller diameter than the outer cup, or a press-fit ring which is preferably slotted—that is, has a slot.

The upper side and the underside of the disk preferably each transition to the outer shell surface via a bevel. This ensures that there is always a spacing from the outer shell surface when the edge contact is attached.

The primer cap according to the invention is preferably used for pistol and rifle ammunition in the caliber range from 4.6 mm to 12.7 mm.

The invention is described below with reference to a preferred embodiment of the primer cap.

FIG. 1 shows a (thin) disk 1 according to the invention, having an ohmic resistor as a resistance bridge 2 which can be initiated electrically. The upper side and the underside of the disk 1 are metallized. Only the outer shell surface 9, the inner region 11, and a bevel 10 on each side, which forms the transition zone between the upper side and/or the underside and the shell surface 9 of the disk 1, are not metallized, and are therefore insulating. Merely to improve the clarity, the annular insulating region 11 which separates the edge region 8*d* and/or the outer metallizing from the inner metallizing 8*c* is illustrated as recessed. These two regions 8*c* and 8*d* are connected only via the resistance bridge 2.

Figure 1:
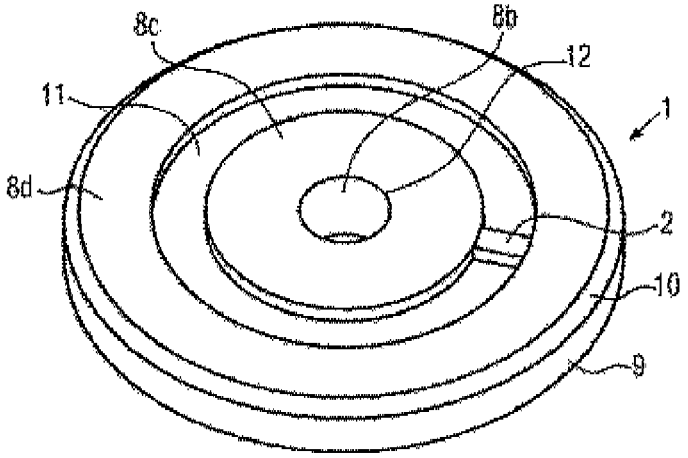

An electrically conducting pole piece 5 is arranged in the outer cup 3, wherein the first pole of the resistance bridge 2 is connected to the cup 3 and the second pole is connected to a pole piece 5 which projects out of the cup into a hole 14, and is electrically insulated from the same via insulation 4.

The actual ohmic resistor, i.e., the resistance bridge 2, is attached as a metal film to the thin disk 1 made of insulating material with a metallized upper side and underside. This disk 1 forms a stable and well-defined base for the production process, but at the same time is elastic up to a certain degree so that it can be contacted, without breaking, by pressing on the contacts. On the upper side of the disk, the resistance bridge 2 is formed by a thin layer of a high-resistance material (e.g., a CrNi alloy). A radial region 11 on the upper side, the length of which corresponds to the length of the resistance bridge, along with the outer shell surface 9 and its transition bevels 10, are not metallized. The precise geometry of the resistance bridge 2 (length, width, thickness) determines the value of the ohmic resistance of the resistance bridge 2 and the subsequent sensitivity of the primer cap, and can be easily adapted to requirements.

Typical resistances are within the lower single-digit ohm range, and the voltages required for ignition are generally below 10 V. High voltage is not necessary. However, the constructive design of the geometry of the resistance bridge 2 makes it possible to render the ANZDH insensitive to electrostatic charge. The second pole of the resistance bridge 2 is situated, as metallizing 8*a*, on the underside of the disk 1. The other first pole of the resistance bridge 2 is situated, as an edge region 8*d*, on the edge of the upper side. The current can flow through a small hole 12 in the center of the disk 1, whose walls are metallized, from the underside and/or the metallizing 8*a* thereof, via the metallized walls 8*b* of the hole 12, to the inner metallizing 8*c* and the second pole of the resistance bridge 2.

Figure 2:
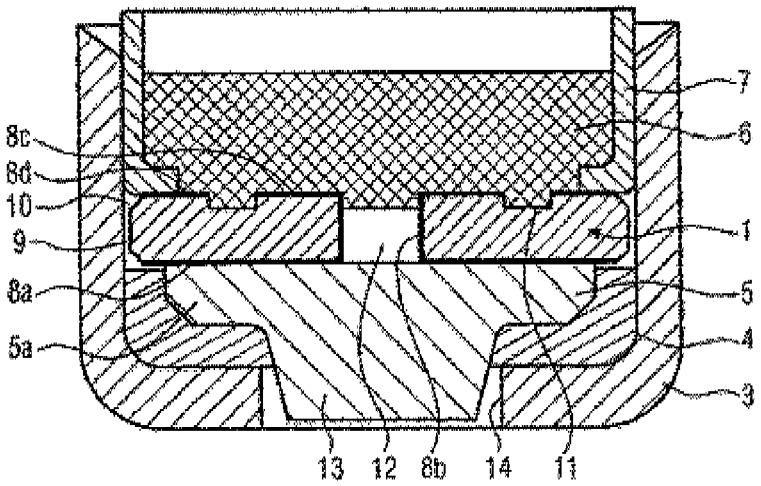
FIG. 2 shows a schematic cross-section of an electric primer cap according to the invention for small-caliber ammunition.
Figure 3:
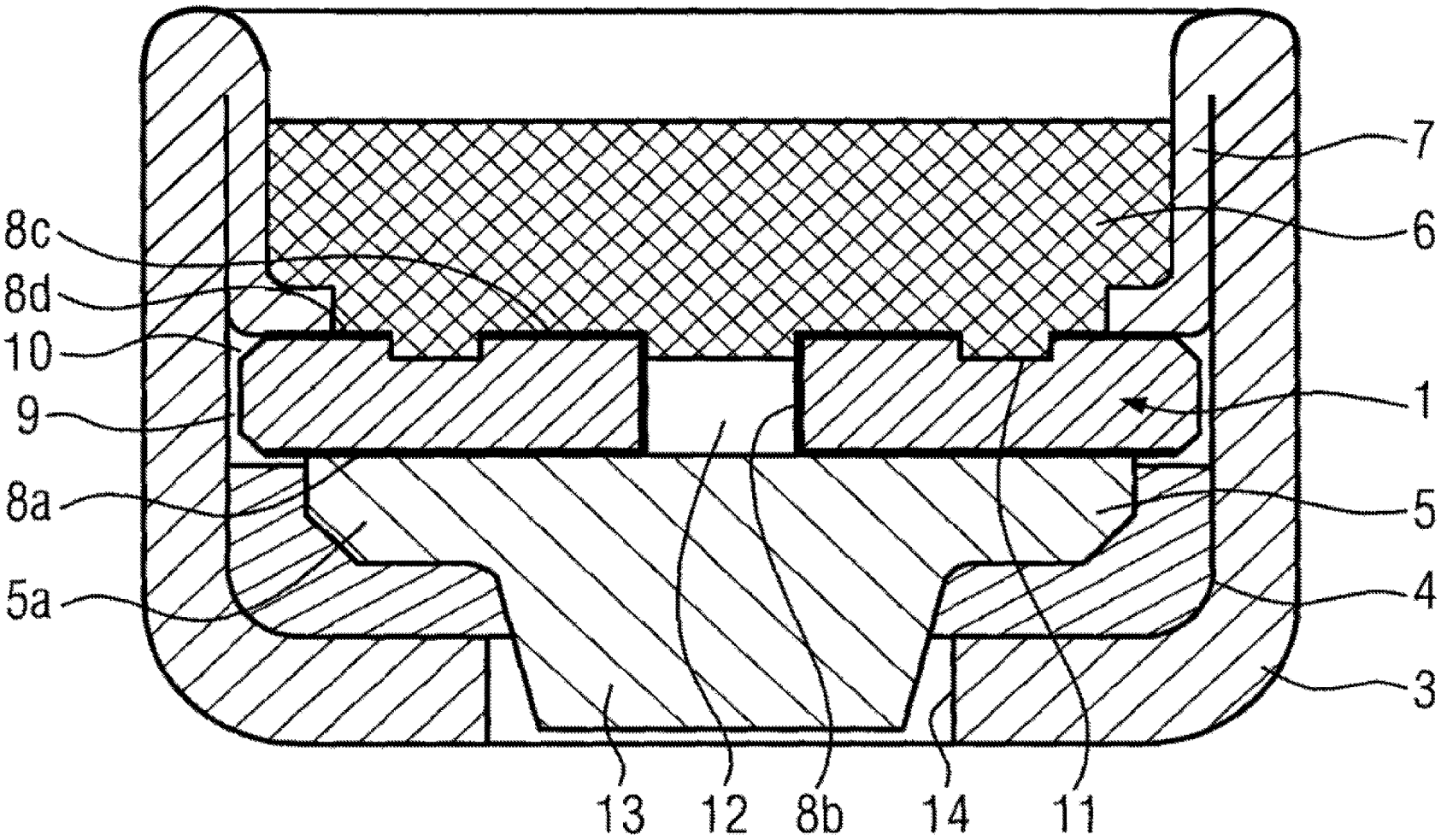
FIG. 3 shows a schematic cross-section of an electric primer cap according to another embodiment of the invention for small-caliber ammunition.

An electrically conducting support element is pressed onto the edge region 8*d* of the upper side of the disk I, which fixes the disk I in its position and ensures the electrical contact to the outer cup 3 of the primer cap, and therefore to the case of the small-caliber ammunition. This upper support element, which establishes the metallic contact to the outer metallic cup 3, can be designed in various ways. For example, the upper side of the outer cup 3 can be curved inwardly by 180°, and this curved part 7' forms the support element (see FIG. 3). Or, an inner cup 7 with a smaller diameter can be used (see FIG. 2). Or, only a small (possibly slotted) ring, or multiple rings, can be pressed in. All support elements must be supported against the inner wall of the outer cup 3. However, other approaches which hold the disk in position and ensure electrical contact with the outer cup 3 can also be contemplated.

The primer composition (AZM) 6 is pressed onto the upper side of the disk 1—that is, into the upper open space of the primer cap—in the same way as in a classical, mechanical ANZDH. The composition of the AZM 6 can be adapted for the special requirements of the electric initiation (e.g., by avoiding particularly impact-sensitive components). As with mechanical primer caps, the AZM is closed with a cover and a paint so that no dust deposits can escape during subsequent processing.

When an electric voltage is applied to the pole piece 5 or to the pin 13 thereof and to the outer cup 3 which forms the bullet case of the primer cap, current can flow: from the pole piece 5 into the metallizing 8*a*, to the underside of the disk 1, through the metallizing 8*b* in the central hole 12 of the disk 1, to the inner metallizing 8*c*, to the upper side of the disk 1, through the ohmic resistor of the resistance bridge 2, to the outer metallizing or the edge contact 8*d*, to the upper side of the disk 1, the inner cup 7, and finally to the outer cup 3.

The resistor of the resistance bridge 2 is heated by the flow of current, and the primer composition 6 pressed onto same is initiated. The ignition gases formed during the subsequent chemical reaction can exit the ANZDH from the top thereof. They then flow in a cartridge to the propellant powder and ignite the same. The metallized portions of the disk 1 are indicated by the reference number 8, i.e., 8*a*, 8*b*, 8*c*, 8*d*.

Figure 4:
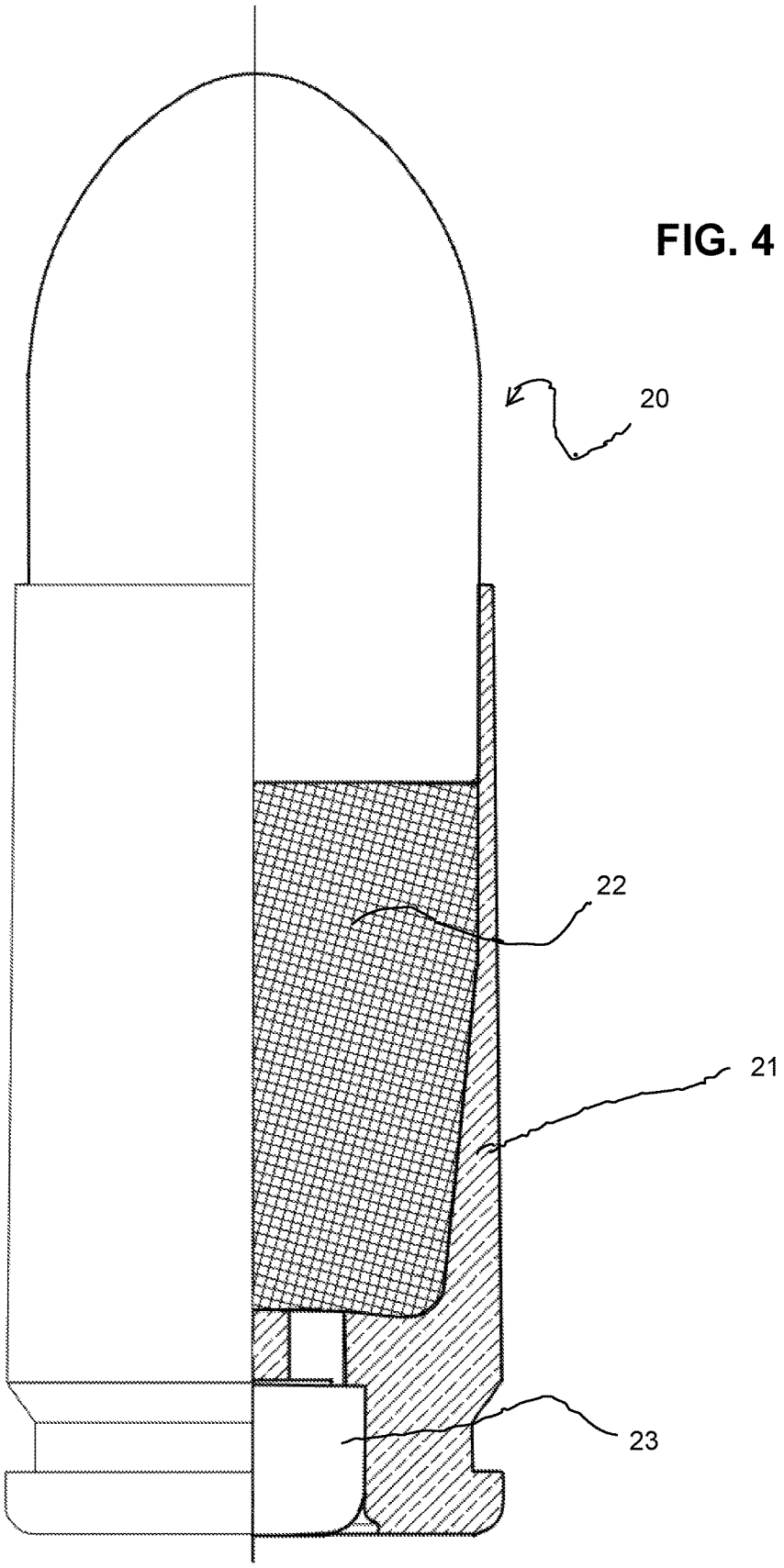
FIG. 4 shows small-caliber pistol and rifle ammunition comprising the primer cap according to the invention.

Depending on the caliber of the small-caliber ammunition, different sizes of ANZDH with different amounts of primer are used. The dimensions and construction of the primer cap illustrated here allow scaling without further considerations, such that it is possible to produce primer caps for pistol and rifle ammunition in the caliber range from 4.6 mm to 12.7 mm. FIG. 4 shows small-caliber pistol and rifle ammunition 20 including a cartridge 21, propellant powder 22 in the cartridge 21, and a primer cap 23. The primer cap of the present can be used as the primer cap 23 of the small-caliber ammunition, the primer cap 23 being connected to the propellant powder 22 in the cartridge 21.

The invention claimed is:

1. A primer cap for small-caliber ammunition, comprising:

an outer metallic cup in which is arranged a priming composition configured to ignite and generate combustion gases following initiation, the outer metallic cup having a hole provided therein, an electrically conductive pole piece arranged in the outer metallic cup having a portion projecting into the hole in the outer metallic cup and electrically insulated from the outer metallic cup, a disk comprising an electrically insulating material having an upper side which faces the priming composition, an underside which faces the electrically conductive pole piece, and a hole extending through the electrically insulating material from the upper side to the underside, and a resistance bridge arranged on the upper side of the electrically insulating material, wherein the underside of the electrically insulating material and the hole of the electrically insulating material are each provided with metal layers that are electrically connected to each other, and a metallic edge contact is arranged on an edge of the upper side and is connected to a first pole of the resistance bridge, and a second pole of the resistance bridge is connected to the metal layer on the hole of the electrically insulating material, wherein the first pole of the resistance bridge is connected to the outer metallic cup via the metallic edge contact, the second pole of the resistance bridge is connected to the pole piece via the metal layer on the underside of the electrically insulating material, and the upper side and the underside of the electrically insulating material each transition to an outer shell surface via a bevel, and an electrically conducting support element which presses the metal layer on the underside of the electrically insulating material against the electrically conductive pole piece, wherein the electrically conducting support element is an edge of the outer metallic cup, the edge of the outer metallic cup being curved inwardly by 180°.

2. The primer cap according to claim 1, wherein the hole in the outer metallic cup is provided in a base of the outer metallic cup, and the portion of the electrically conductive pole piece projecting into the hole provided in the base of the outer metallic cup is a pin, wherein the electrical insulation is arranged between the electrically conductive pole piece and the outer metallic cup.

3. The primer cap according to claim 2, wherein the electrically conductive pole piece has an overhang radially outside the pin.

4. Pistol ammunition in a caliber range from 4.6 mm to 12.7 mm comprising: a cartridge, propellant powder in the cartridge, and a primer cap according to claim 1 operably connected to the propellant powder in the cartridge.

5. Rifle ammunition in a caliber range from 4.6 mm to 12.7 mm comprising: a cartridge, propellant powder in the cartridge, and a primer cap according to claim 1 operably connected to the propellant powder in the cartridge.

6. A primer cap primer cap for small-caliber ammunition, comprising:

an outer metallic cup in which is arranged a priming composition which generates combustion gases following initiation, the outer metallic cup having a hole provided therein, an electrically conductive pole piece arranged in the outer metallic cup having a portion projecting into the hole in the outer metallic cup and electrically insulated from the outer metallic cup, a disk comprising an electrically insulating material having an upper side which faces the priming composition, an underside which faces the electrically conductive pole piece, and a hole extending through the electrically insulating material from the upper side to the underside, and a resistance bridge arranged on the upper side of the electrically insulating material, wherein the underside of the electrically insulating material and the hole of the electrically insulating material are each provided with metal layers that are electrically connected to each other, and a metallic edge contact is arranged on an edge of the upper side and is connected to a first pole of the resistance bridge, and a second pole of the resistance bridge is connected to the metal layer on the hole of the electrically insulating material, wherein the first pole of the resistance bridge is connected to the outer metallic cup via the metallic edge contact, the second pole of the resistance bridge is connected to the pole piece via the metal layer on the underside of the electrically insulating material, and the upper side and the underside of the electrically insulating material each transition to an outer shell surface via a bevel, and an electrically conducting support element which presses the metal layer on the underside of the electrically insulating material against the electrically conductive pole piece.

7. The primer cap according to claim 6, wherein the hole in the outer metallic cup is provided in a base of the outer metallic cup, and the portion of the electrically conductive pole piece projecting into the hole provided in the base of the outer metallic cup is a pin, wherein the electrical insulation is arranged between the electrically conductive pole piece and the outer metallic cup.

8. The primer cap according to claim 7, wherein the electrically conductive pole piece has an overhang radially outside the pin.

9. Pistol ammunition in a caliber range from 4.6 mm to 12.7 mm comprising: a cartridge, propellant powder in the cartridge, and a primer cap according to claim 6 operably connected to the propellant powder in the cartridge.

10. Rifle ammunition in a caliber range from 4.6 mm to 12.7 mm comprising: a cartridge, propellant powder in the cartridge, and a primer cap according to claim 6 operably connected to the propellant powder in the cartridge.

* * * * *